US005707212A

United States Patent [19]

Matthews

[11] Patent Number: 5,707,212

[45] Date of Patent: Jan. 13, 1998

[54] APPARATUS FOR PRECISELY CONTROLLING THE FEEDING OF VISCOUS AND NON-VISCOUS LIQUID PRODUCTS INTO A PACKAGING MACHINE

[76] Inventor: Ernest L. Matthews, 2611 Old River Rd., SE., Decatur, Ala. 35603

[21] Appl. No.: 441,041

[22] Filed: May 12, 1995

[51] Int. Cl.[6] ..... F04B 49/06

[52] U.S. Cl. ..... 417/44.1; 417/415; 417/539

[58] Field of Search ..... 417/44.1, 53, 415, 417/539

[56] References Cited

U.S. PATENT DOCUMENTS

| | | | |
|---|---|---|---|
| 2,433,664 | 12/1947 | Hantjopoulos | 417/539 |
| 4,074,611 | 2/1978 | Hereth | 91/179 |
| 4,493,614 | 1/1985 | Chu et al. | 417/415 |
| 4,687,426 | 8/1987 | Yoshimura | 417/539 |
| 4,919,596 | 4/1990 | Slate et al. | 417/415 |
| 5,154,586 | 10/1992 | Rudick | 417/415 |
| 5,253,981 | 10/1993 | Yang et al. | 417/415 |
| 5,286,177 | 2/1994 | Johann | 417/415 |
| 5,312,233 | 5/1994 | Tanny et al. | 417/415 |

*Primary Examiner*—Timothy Thorpe
*Assistant Examiner*—Xuan M. Thai
*Attorney, Agent, or Firm*—Veal & Associates

[57] ABSTRACT

Precise control of the vertical motion of a piston or series of pistons within a cylindrical housing of a positive displacement pumping device to precisely set the discharge volume of viscous and non-viscous liquid products from the pistons. Uses a linear ball bearing screw actuated by an electronically-controlled servo motor. An electronic pulse generator incorporated in the servo motor provides pulses which are counted and used to set the maximum range of movement of the pistons.

2 Claims, 4 Drawing Sheets

APPARATUS FOR PRECISELY CONTROLLING THE FEEDING OF VISCOUS AND NON-VISCOUS LIQUID PRODUCTS INTO A PACKAGING MACHINE

FIELD OF THE INVENTION

The present invention relates to the field of packaging. More particularly, the present invention relates to packaging of viscous and non-viscous liquids and, in even greater particularity, the present invention relates to the individual dosing of viscous and non-viscous liquid products using a positive displacement pumping device with precision servo motor control of the movement of the pistons.

BACKGROUND OF THE INVENTION

Various methods of dispensing individual doses of viscous or non-viscous liquid products exist. One of the most common methods of dispensing these products is the positive displacement pump. In a positive displacement pump, a piston moving within a cylindrical compartment draws the product into the cylinder through an orifice or port during its intake stroke. Upon reaching the upper limit of its stroke, the piston reverses direction, discharging the product through a second orifice or port. The quantity of product discharged is primarily determined by the diameter of the cylinder and the length of the piston stroke. A valve unit opens and closes the orifices or ports in the cylinder to either open the cylinder to the product supply or to allow the product to be discharged into its final package.

On most packaging machines incorporating a positive displacement pump unit, the pistons are moved via a mechanical linkage to other driven elements of the machine. These linkages rely on springs, pneumatic pressure, or gravity to guarantee uniform stroke lengths. Because of varying machine speeds, normal wear on linkages, rollers, and guides, and other random factors, the stroke length may vary slightly from cycle to cycle, yielding inconsistent volumes of discharged products, in accordance with the cross-sectional area of the piston and the variance in the stroke length.

SUMMARY OF THE INVENTION

The principal object of the invention is to accurately dose a liquid taken from a reservoir for subsequent packaging.

In furtherance of that object, another object of this invention is to provide a means of positively controlling the stroke of the pistons in a positive displacement pump unit independently of other machine actions. These and other objects and features are accomplished using an electrically-controlled servo motor as the drive force for the pump. The servo motor turns a ball bearing screw assembly which is coupled to the pistons via a metal beam. As the servo motor turns the ball bearing screw assembly, it moves the pistons in and out of the cylinders. By precisely sensing the rotation of the servo motor and counting electrical pulses generated by its rotation, the motor is repeatedly stopped in precisely the same location after causing the piston beam to travel a precise distance.

BRIEF DESCRIPTION OF THE DRAWINGS

The features of this invention are depicted in the drawings accompanying and forming a part of this disclosure, wherein.

DESCRIPTION OF THE PREFERRED EMBODIMENT

Figure 1:
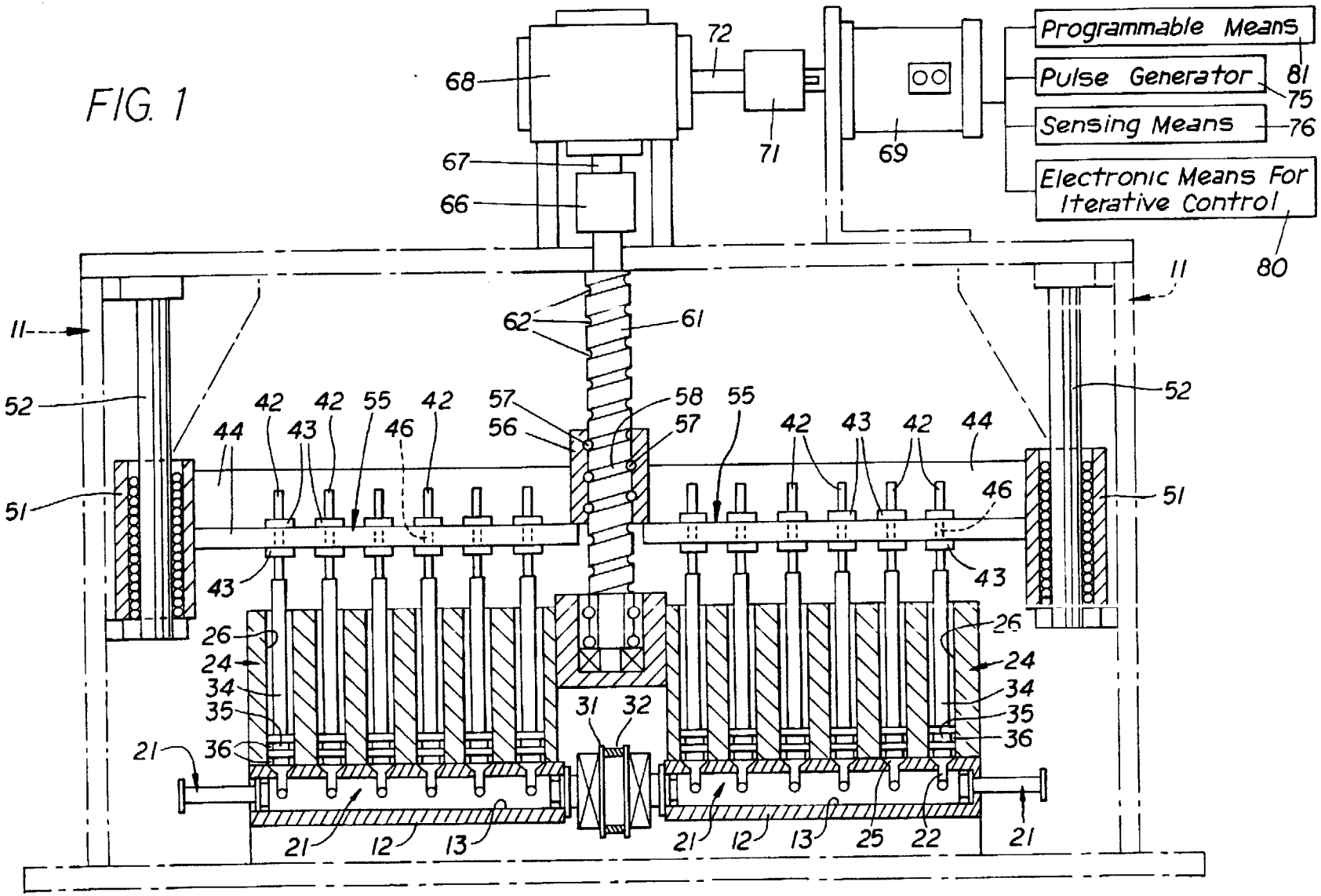
FIG. 1 is a front elevational view of the apparatus, partly in section and partly broken away, with certain frame and support members omitted for clarity.
Figure 2:
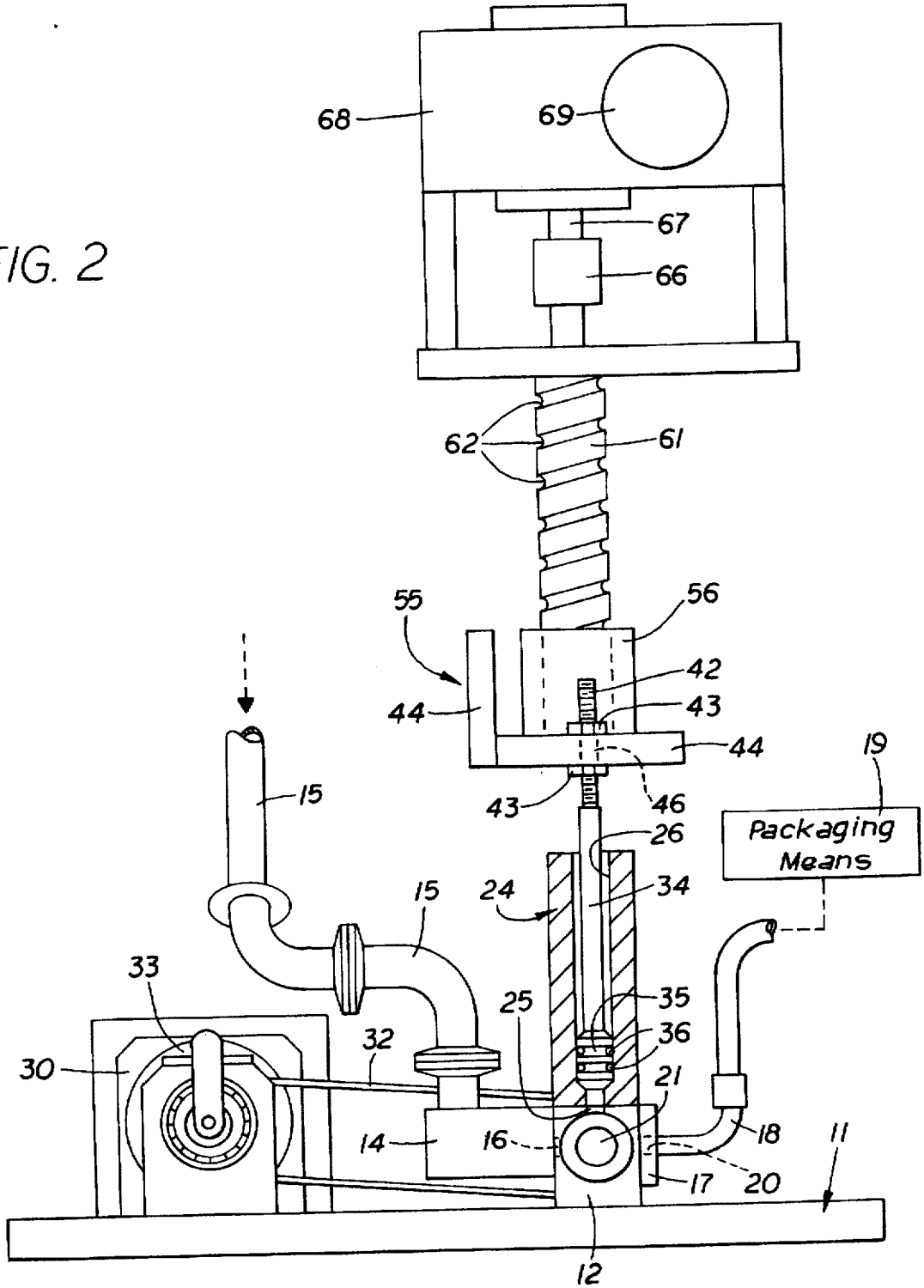
FIG. 2 is a right-side elevational view of the apparatus, partly in section and partly broken away, with certain frame and support members omitted for clarity.
Figure 3:
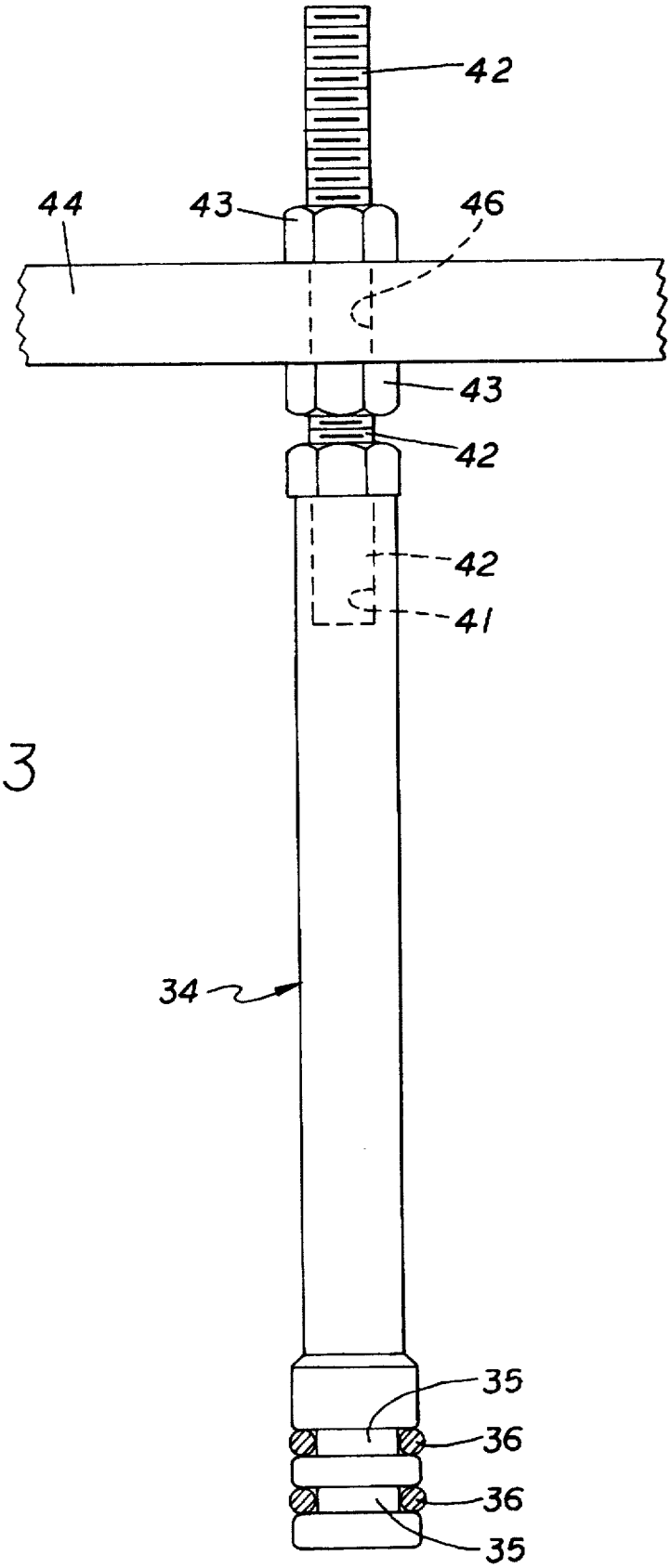
FIG. 3 is a side view of a ball bearing screw and nut.

Referring to the drawings for a clearer understanding of the invention, it may be seen in FIGS. 1 and 2 the apparatus is presented in the vertical orientation for sake of clarity. Those familiar with the art will understand that the concept is applicable to orientation in any plane at any determined angle.

A basic machine framework 11 provides a stable mounting base for additional parts and assemblies which are not germane to the invention and are thus omitted. Mounted to the base plate is a machined stainless steel rotor housing 12 with a cylindrical bore 13 through its length. A steel product supply manifold chamber 14 with tubular connections 15 for product is fastened to the rear of the rotor housing 12 and communicates with the rotor housing through machined openings or orifices 16. In a similar manner on the front side of the rotor housing, a stainless steel plate 17 containing a number of formed stainless steel product fill tubing connectors 18 communicates with ports or orifices 20 in the rotor housing 12 to deliver product to a downstream packaging machine.

Figure 5:
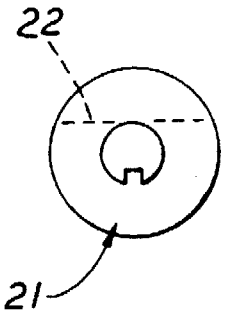
FIG. 5 is an end view of a product rotor.

Within rotor housing 12 a cylindrical stainless steel rotor 21 is mounted for rotation about its axis. The rotor, which is illustrated in side and end views in FIGS. 4 and 5 contains channels 22 cut through approximately 120° of arc tangent to the surface of the rotor and perpendicular to the axis of the bore 13.

Bolted directly to the upper surface of and communicating with the rotor housing 12 is a stainless steel cylinder block 24 containing one of more cylindrical bores or cylinders 26. Ports or orifices 25 in the upper surface of the rotor housing 12 are aligned with the cylinders 26 so as to provide a clear path from the rotor channels 22 to the interior of the cylinders 26. The channels 22 in rotor are aligned such that they provide selective communication between orifices 25 and either intake ports 16 or discharge orifices 20 in the rotor housing 12. In its initial position, the rotor 21 presents the channel 22 towards the product supply manifold 14 and thus opens a direct path from the product supply manifold to the cylinders 26. When the rotor 21 rotates through 90° of travel, it then presents the direct pathway of the channel 22 from the cylinder 26 to the tubing connected to orifice 20. A pulley 31 with preformed grooves cut parallel to the axis of pulley rotation is affixed to one end of the rotor 21 external to the rotor housing 12. The pulley 31 accepts similarly formed elements of a continuous loop of flexible belt material 32, which is in turn connected through an identical pulley 33 to the means of rotation 30 for the rotor 21.

Figure 4:
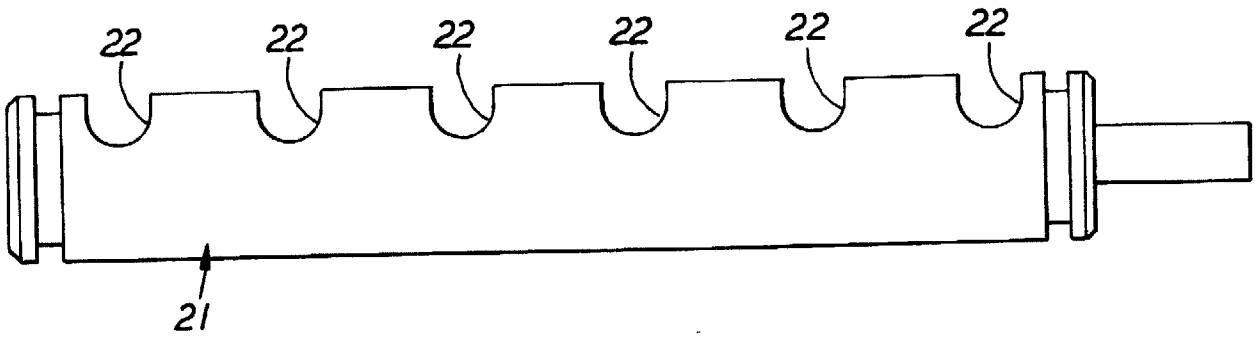
FIG. 4 is a side view of a product rotor.

A machined piston 34 as illustrated in FIG. 4 is inserted in each cylinder 26 in the cylinder block 24. The piston contains preformed grooves in the end 35 to allow installation of flexible rubber sealing rings 36. Vertical movement of the piston within the cylinder 26 changes the interior volume of the portion of the cylinder which communicates with the rotor housing 12. As the piston 34 moves away from the rotor housing 12 and increases the interior volume of the cylinder 26, it decreases the pressure within the cylinder. This decrease in pressure draws product from the product supply connections 15 through the product supply manifold 14 through the channel 22 in the rotor 21 and the ports or orifices 16 and 25 in the rotor housing 12 and into the cylinder 26. When the piston 34 reverses direction and the rotor 21 rotates 90°, the product is forced by the pressure of the moving piston through the channel 22 in the rotor 21 and out of the rotor housing 12 through the product fill tubing connectors 18. The rubber sealing rings 16 prevent the escape of product into the remaining area of the cylinder 26.

The top of the piston 34 is machined with female screw threads 41, allowing assembly with a mating male threaded piston rod 42. Piston rod 42 carries coaxial threaded fasteners 43 to facilitate connection to a piston beam 44. The piston beam 44 contains a predetermined number of channels 46 which accept the piston rods 42. Tightening the fasteners 43, one on the upper surface and one on the lower surface of the piston beam 44, fixes the distance between the piston beam 44 and the bottom edge of the piston 34.

On either side of the piston beam 44, ball bushings 51 permanently affixed to the piston beam 44 travel along hardened steel shafts 52 which are affixed to the machine framework 11. The ball bushings 51 allow free range of movement along the shaft 52 in a plane perpendicular to cylinder block 24 while maintaining the piston beam 44 to the cylinder block 24.

A ball bearing nut 56 is connected to the center of the piston beam 44. The ball bearing nut 56 and piston beam 44 comprise the carriage assembly 55. The ball bearing nut 56 contains a number of precision steel balls 57 in a recirculating chamber 58. The ball bearing nut 56 communicates with a ball bearing screw 61, having channels 62 machined therein to accept the diameter of the steel balls 57 contained in the ball bearing nut 56. As the ball bearing screw 61 rotates, the balls in the ball bearing nut 56 are forced along the channels in the ball bearing screw 61. As the balls reach the edge of the ball bearing nut 56, the are recirculated back to the opposite end of the nut for reuse. The net effect of the applied movement of the ball bearing screw 61 is that the ball bearing nut 23 travels along the ball bearing screw 61 while the ball bearing screw is rotated. The direction of travel is altered by reversing the direction of rotation of the ball bearing screw 61. The distance of travel of the ball bearing nut 56 is determined by the number of rotations of the ball bearing screw 61 and the pitch of the channel 62.

The ball bearing screw 61 is coupled directly with a metal coupling 66 to the output shaft 67 of a gearbox 68 mounted on the machine framework 11. A servo motor 69 is connected by a direct metal coupling 71 to an input shaft 72 of the gearbox 68. An electronic pulse generator, not shown, incorporated within the servo motor 69 provides precise information regarding the present rotational position of the servo motor. By counting the number of electrical pulses generated by the servo motor 69 and starting and stopping the servo motor based upon an accurate count of said pulses, an exact amount of vertical movement of the piston beam 44 can be determined.

It is to be understood that servo motors, such as are used in this application are commercially available and have control circuits associated with them by the manufacturer thereof which enable the motor to be precisely controlled in terms of the incremental rotation of the motor. Likewise, for each servo motor, the incremental rotation of an output shaft associated therewith is readily determined. Accordingly, the details of the control circuit are not presented herein because they are well within the ken of those familiar with servo motors. The control circuit is interfaced with a Programmable Logic Circuit (PLC) such as are available from such manufacturers as Allen Bradley, Texas Instruments, or Siemens, and the PLC is interfaced with a personal computer to establish an operator input and parameter display mechanism. Any control software such as a touchscreen control system as provided by Microsoft Corporation may be used to provide the interface between the operator and the pump. It will be appreciated that the control circuit will be provided with data on the parameters of the cylinders and variable piston stroke length to compute the effective volume within the cylinders for various stroke lengths. The ratio of the incremental angular rotation of the worm or ball bearing screw to the incremental linear movement of the ball bearing nut and hence the piston bar and pistons is also input, such that the programmable logic and operator interface may be used to vary the stroke length and volume by varying the amount of rotation of the servo motor.

Thus, by carefully controlling the number of revolutions of the servo motor 69, the distance of travel of the piston beam 44 and thus the interior volume of the cylinders 26 can be adjusted to precisely control the amount of product drawn into the cylinder from the product supply manifold chamber 14 and expelled through the product fill tubing connectors 20 and through flexible hoses to the final processing stage.

While I have shown my invention in one form, it will be obvious to those skilled in the art that it is not so limited but is susceptible of various changes and modifications without departing from the spirit thereof.

What I claim is:

1. Apparatus for precisely controlling the feeding of viscous and non-viscous fluid products into a packaging machine comprising in combination:

a. fluid intake means connected to a reservoir of fluid to be feed into a packaging machine;

b. fluid discharge means connected to a packaging machine to supply fluid thereto;

c. positive displacement pump means for drawing fluid through said fluid intake means and urging fluid through said discharge means, comprising a plurality of cylinders in parallel alignment each having an axial port, a piston mounted in each cylinder of said plurality cylinders for concomitant reciprocal movement therewithin, a reversible motor having an output shaft with an elongated worm coupled to said output shaft for concomitant rotation therewith and a carriage coupled to said worm for linear motion along the length thereof responsive to rotation of said worm by said motor, said carriage coupled to said pistons for urging said pistons linearly within each said cylinder a fixed linear increment per incremental rotation of said reversible motor;

d. rotary valve means interposed between said pump means and said intake and discharge means to selectively connect said pump means and said intake and discharge means; and, e. electronic means for iterative control of the displacement of said pump means, including a pulse generator coupled to said output shaft to generate a predetermined number of pulses per revolution of said shaft and programmable means for determining the movement of said carriage along said worm operably connected to said pulse generator to detect an output therefrom, and operably connected said motor to control the rotation thereof in response to said sensed rotation wherein said motor is a servo motor having a predetermined number of pulses per revolution of said output shaft and wherein said programmable means is programmed to correlate the number of pulses generated with the number of pulses required to move said servo motor through a predetermined angular measure and said angular measure with the linear movement of said carriage.

2. Apparatus as defined in claim 1 wherein said carriage comprises a ball bearing nut coupled to said worm such that ball bearings are urged along helical raceways on said worm to impart linear motion to said nut, at least one piston beam extending radially from said nut, guide means affixed to said piston beam distal said nut for maintaining said piston beam in radial alignment with said nut, said piston beam affixed to said piston.

* * * * *